US005305209A

United States Patent [19]

Stein et al.

[11] Patent Number: 5,305,209

[45] Date of Patent: Apr. 19, 1994

[54] METHOD FOR CHARACTERIZING SUBTERRANEAN RESERVOIRS

[75] Inventors: Michael H. Stein, Houston, Tex.; Francis M. Carlson, Broken Arrow, Okla.

[73] Assignee: Amoco Corporation, Chicago, Ill.

[21] Appl. No.: 649,646

[22] Filed: Jan. 31, 1991

[51] Int. Cl.[5] ..... G01V 1/00

[52] U.S. Cl. ..... 364/420

[58] Field of Search ..... 364/420, 421, 422; 367/73, 78; 73/151, 152

[56] References Cited

U.S. PATENT DOCUMENTS

| | | | |
|---|---|---|---|
| 4,607,524 | 8/1986 | Gringarten | 73/152 |
| 4,797,821 | 1/1989 | Petak et al. | 364/422 |
| 4,799,157 | 1/1989 | Kucuk et al. | 364/422 |
| 4,969,130 | 11/1990 | Wason et al. | 367/73 |

OTHER PUBLICATIONS

J. Barua, et al., "Improved Estimation Algorithms for Automated Type-Curve Analysis of Well Test Data", SPE 1985.

A. J. Rosa, et al., "Automated Type-Curve Matching in Well Test Analysis Using Laplace Space Determination of Parameter Gradients", SPE 1983.

J. C. Ader, et al., "Slaughter Estate Unit $CO_2$ Pilot Reservoir Description via a Black Oil Model Waterflood History Match", SPE/DOE 1982.

C. C. Mattax, et al., "Reservoir Simulation, SPE Monograph Series", vol. 13 (1990), Chapters 1, 3, 6, 8.

*Primary Examiner*—Roy N. Envall, Jr.
*Assistant Examiner*—Xuong Chung
*Attorney, Agent, or Firm*—James A. Gabala; Richard A. Kretchmer

[57] ABSTRACT

A novel method for characterizing multilayer subterranean reservoirs comprising forming a single layer reservoir model representative of the flow parameters of the multilayer reservoir and developing a set of predicted flow rates from a numerical reservoir simulator. The predicted flow rates are scaled to form a set of dimensionless flow rates. Differences between actual reservoir flow rates and predicted flow rates obtained from the dimensionless flow rates, are minimized automatically to obtain estimates of flow parameters for each layer of the multilayer reservoir. Additionally, for a given set of flow parameters, the optimum injection and production well patterns as well as injection and production well operating conditions can be determined for producing hydrocarbon from the multilayer reservoir.

10 Claims, 13 Drawing Sheets

METHOD FOR CHARACTERIZING SUBTERRANEAN RESERVOIRS

BACKGROUND OF THE INVENTION

The present invention relates generally to the field of enhanced hydrocarbon recovery and more particularly to a method for characterizing multilayer subterranean reservoirs.

Initial hydrocarbon production from subterranean reservoirs is generally referred to as "primary" production. During primary production, only a fraction of the hydrocarbon in the reservoir is recovered. Thereafter, additional hydrocarbon can be recovered employing enhanced hydrocarbon recovery techniques by injecting fluids such as water, steam, nitrogen, $CO_2$ or natural gas into the reservoir and such subsequent production is generally referred to as "secondary" or "tertiary" production. Enhanced recovery techniques generally depend on the injected fluid to displace the hydrocarbon from its in-situ location and direct it towards a producing well from which it can be recovered. Because of the substantial economic cost required to develop and implement enhanced recovery techniques, it is critically important for a reservoir engineer to characterize the storage and flow capacity of a hydrocarbon bearing reservoir. More particularly, it is important for the reservoir engineer to describe the distribution of porosity, permeability, and thickness of the various reservoir layers and to be able to optimize both the spacing and operating conditions of injection and preduction wells for producing hydrocarbons from a multilayer reservoir. Geological, geophysical and petrophysical analyses can provide a good starting point for an initial estimate of such reservoir properties. However, such analyses can be seriously limited especially with regard to their inability to accurately describe the vertical variation of in-situ reservoir permeability.

Experience in the petroleum industry has indicated that reservoir storage and flow parameters obtained from geological, geophysical and petrophysical data can be used to develop a model of the reservoir and thereafter the model can be input into a numerical reservoir simulator to obtain predictions of reservoir response or performance during enhanced hydrocarbon recovery. The goal of such numerical reservoir simulators is to predict reservoir performance in more detail and with more accuracy than is possible with simple extrapolation techniques. Unfortunately, one seldom knows enough about a reservoir to develop an accurate model describing reservoir storage and flow parameters without testing it in some way and iteratively altering the model of the reservoir until it produces acceptable results. Given the limited amount of information available to delineate the reservoir model, the most useful—and usually the only—way to test the model description of reservoir storage and flow parameters is to simulate past performance of the reservoir and compare the simulation with actual, historical performance. Typically, such "history matching" is done on a trial-and-error basis by modifying selected reservoir storage and flow parameters upon which the reservoir model was derived and iteratively running the numerical reservoir simulator until eventually the simulated performance matches the historical performance.

The history matching technique can be an especially useful and powerful technique to determine reservoir storage and flow parameters. Although such numerical reservoir simulators coupled with trial-and-error history matching techniques have been used with some success to develop reservoir storage and flow parameters, they can consume substantial amounts of computing time as well as be quite expensive and frustrating because reservoir storage and flow parameters can be very complex with numerous interactions. While there are many methods of combined numerical reservoir simulation and trial-and-error history matching, no universally applicable method has evolved. Moreover, such techniques typically involve iteratively, manually adjusting selected reservoir storage and flow parameters and recalculating reservoir performance with the numerical reservoir simulator. Making changes by guessing or by following one's intuition can be expensive and will usually prolong the history matching analysis.

In order to address the aforementioned shortcomings of conventional history matching techniques, the present invention provides an automated method of history matching whereby flow parameters of the reservoir can be determined more quickly and less expensively than can be achieved using present techniques. Additionally, the present invention provides a novel method for determining the optimum injection and production well pattern on spacing as well as optimum operating conditions for producing hydrocarbons from a multilayer reservoir.

SUMMARY OF THE INVENTION

A method of enhanced hydrocarbon recovery is described for characterizing of multilayer subterranean reservoirs. In particular, a single layer reservoir model representative of the storage and flow parameters of the multilayer reservoir is formed and a set of predicted injection and production flow rates for the single layer model is derived employing a numerical reservoir simulator. The predicted flow rates are scaled to form a set of dimensionless performance rates. Differences between actual reservoir flow rates and dimensional performance rates can be minimized to obtain estimates of flow parameters of each layer of the multilayer reservoir. Since dimensionless performance rates from a single layer model are employed, the costly and numerous iterations of a numerical reservoir simulator can be avoided. Moreover, once a set of flow parameters has been determined for the multilayer reservoir, the injection and production well patterns as well as operating conditions thereof can be optimized for producing hydrocarbon production from the multilayer reservoir.

More particularly, dimensionless injection and production flow rates are scaled to provide estimated flow rates for each layer of the multilayer reservoir. An error expression can be developed depicting the difference between estimated and actual, historical flow rates, and such error expression can be minimized to yield estimates of permeability for each layer of the multilayer reservoir. By comparing differences in the estimated fluid injection, hydrocarbon production, and fluid production for the multilayer reservoir obtained by minimizing two or more error expressions, local minima in such error expressions can be identified and more accurate estimates of permeability can be obtained.

The present invention will be better understood with reference to the following drawings and detailed description.

DETAILED DESCRIPTION OF THE INVENTION

In order to more fully understand the present invention, the following introductory comments are provided. To increase the recovery of hydrocarbons from subterranean reservoirs, a variety of enhanced hydrocarbon recovery techniques have been developed whereby a fluid (e.g. water, gas, nitrogen, $CO_2$, steam) is injected into a subterranean reservoir at selected injection wells within a field and hydrocarbons, as well as the injected fluid, can be recovered from the reservoir at selected production wells within the field.

Figure 1:
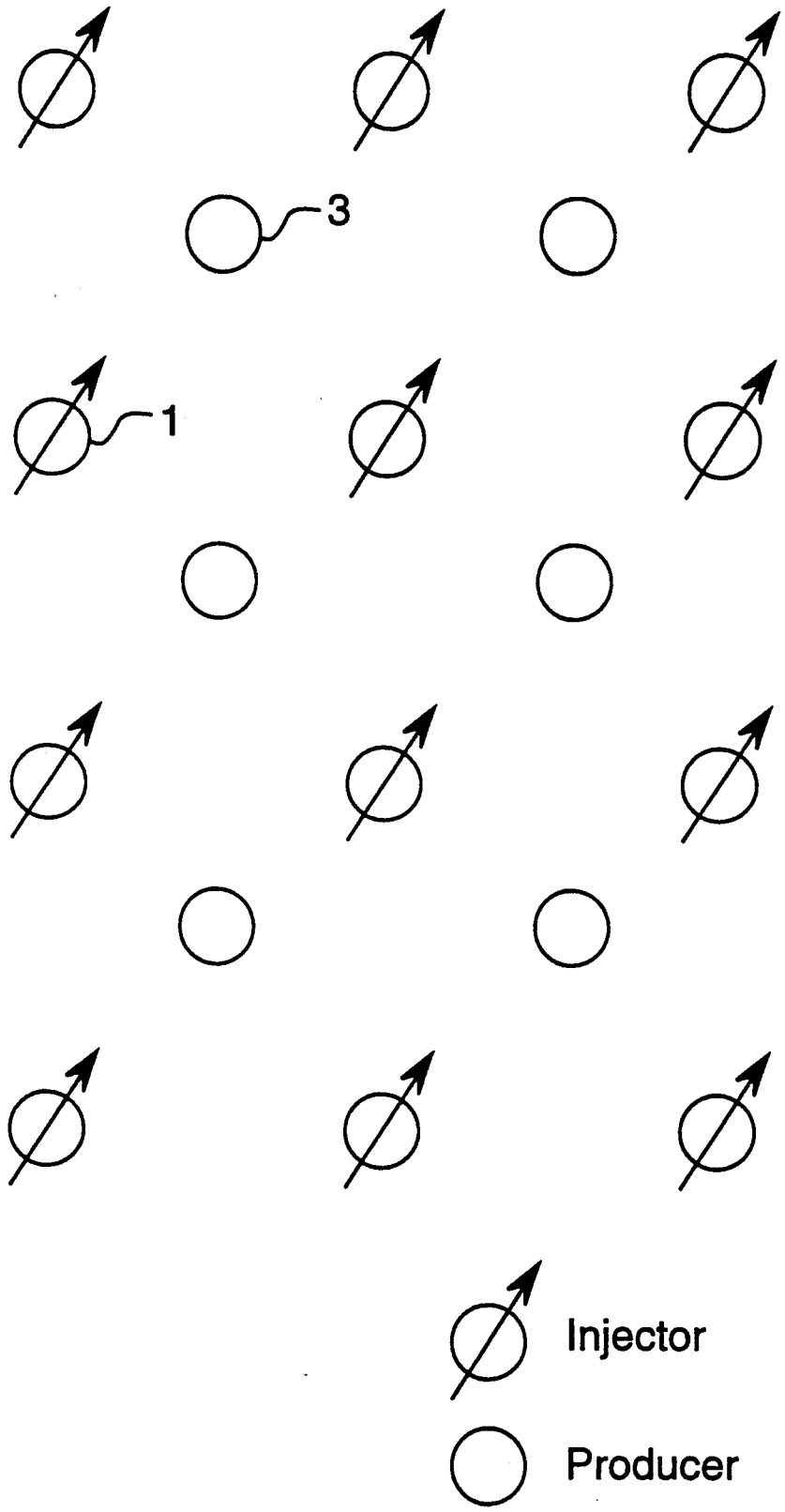
FIG. 1 is a schematic, plan view of a secondary recovery layout of injection wells and production wells.

By way of example, FIG. 1 depicts a schematic, plan view of an enhanced hydrocarbon recovery layout having spaced apart injection wells, indicated by the symbol $\phi$, and spaced apart production wells, indicated by the symbol 0. Numerous arrays of spaced apart injection wells and production wells have been developed for use in different reservoirs. FIG. 1 is representative of a 5-spot configuration wherein each production well is positioned within a grid of four separate injection wells and such pattern is generally repeated throughout the field of interest.

To further assist in understanding the present invention, Table I provides a listing of symbols used throughout the following discussion.

TABLE I

| | |
|---|---|
| $h$ = | reservoir layer thickness |
| $k$ = | permeability to oil at the connate water saturation |
| $kh$ = | reservoir flow capacity or permeability thickness |
| $q^*$ = | fluid injection rate at floodout |
| $Q_O$ = | predicted hydrocarbon production rate |
| $Q_{OD}$ = | dimensionless hydrocarbon production rate |
| $Q_I$ = | predicted fluid injection rate |
| $Q_{ID}$ = | dimensionless fluid injection rate |
| $Q_W$ = | predicted fluid production rate |
| $Q_{WD}$ = | dimensionless fluid production rate |
| $t$ = | actual time |
| $t_d$ = | dimensionless time |
| $\phi$ = | reservoir porosity |
| $\phi h$ = | porosity thickness |
| $A_o$ = | historical hydrocarbon production rate |
| $A_w$ = | historical fluid production rate |
| $A_I$ = | historical fluid injection rate |
| $P_I$ = | bottomhole injection pressure |
| $P_p$ = | bottomhole producing pressure |
| $r_{WI}$ = | effective injection wellbore radius |
| $r_{WP}$ = | effective producing wellbore radius |
| | Subscripts |
| $l$ = | reservoir layer |
| $T$ = | total |
| $i$ = | discrete time |

Figure 2A:
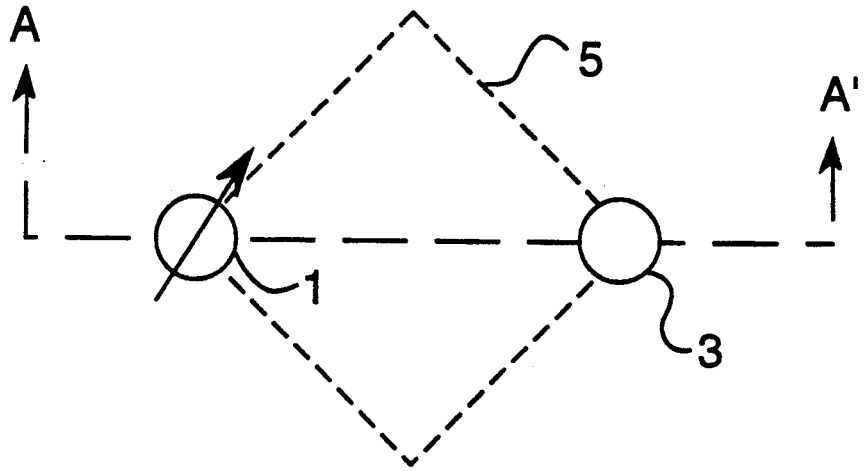
FIG. 2A is an enlarged view of FIG. 1 depicting injection well 1 and production well 3.

Looking now to FIG. 2A, a schematic, plan view is depicted of injection well 1 and production well 3 from FIG. 1. Dashed line 5, forming a generally rectangular box, is intended to depict an assumed no flow boundary delineating the flow impact of injection well 1 into production well 3, i.e. approximately ¼ of the input of injection well 1 results in approximately ¼ the output of production well 3. While the effective area swept out by injection well 1 and its impact on the output of production well 3 is assumed to be uniform and thus may not accurately represent the varying storage and flow parameters of the reservoir, such assumption is frequently the starting point for developing reservoir storage and flow parameters and can nevertheless produce quite useable results.

Figure 2B:
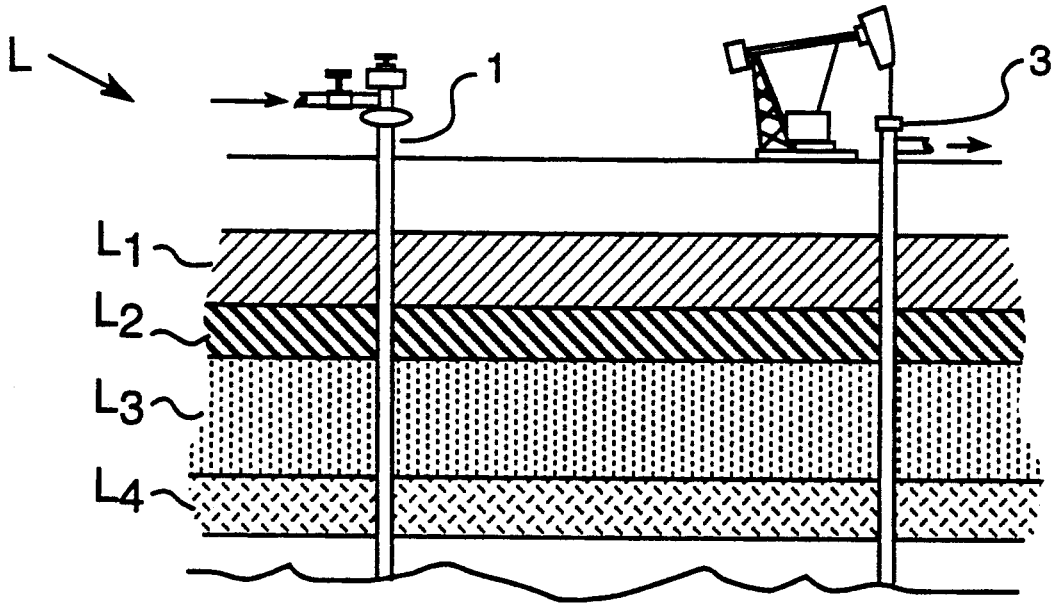
FIG. 2B is a schematic, cross-sectional view of FIG. 2a along section line A—A.

FIG. 2B depicts a cross sectional view of a multilayer reservoir L along section line A-A' of FIG. 2A. In particular, injection well 1 and production well 3 are both shown along with the multilayer reservoir L into which fluid is injected and from which it is desired to recover additional hydrocarbons. To aid in the following discussion a four layer model has been employed. However, the use of a four layer model in the following discussions is not intended to be a limitation of the present invention, but rather, a simple example which permits ease of discussion while illustrating certain features of the present invention. Associated with each of the layers ($L_1$, $L_2$, $L_3$ and $L_4$) of the multilayer reservoir L is a measure of permeability $k_l$, porosity $\phi_l$ and layer thickness $h_l$. Hereafter, the subscript l is intended to refer to any of the specified layers ($L_1$, $L_2$, $L_3$, $L_4$).

Presently, multilayer models of the such multi-layer reservoir are developed from initial estimates for porosity-thickness $(\phi h)_l$, and permeability-thickness $(kh)_l$ for each layer l of the reservoir as well as from other measures of the reservoir's storage and flow parameters. Typically, initial estimates of porosity-thickness $(\phi h)_l$, and permeability-thickness $(kh)_l$ as well as other measures of the reservoir's storage and flow parameters can be obtained from geological, geophysical or petrophysical data. While estimates of porosity-thickness $(\phi h)_l$ and layer thickness $h_l$ can be fairly reliable, estimates of permeability-thickness $(kh)_l$ can be in error by several orders of magnitude.

Such multilayer model of the multilayer reservoir can then be used in conjunction with a numerical reservoir simulator to obtain predictions of reservoir performance (i.e., injection rate as well as production rates) for an assumed set of reservoir conditions, e.g., production pressure, initial gas saturation, etc. Typically, such numerical reservoir simulators comprise highly sophisticated computer programs adapted to operate on large mainframe computers as more completely described by C. C. Mattax et al. in "Reservoir Simulation" SPE Monograph Series Vol. 13 (1990). Presently, predicted and actual historical performance of the multilayer reservoir are compared and differences there between can be forced to converge by iteratively modifying certain of the storage and flow parameters of the multilayer model and recalculating reservoir performance with the numerical reservoir simulator until a satisfactory match between predicted and actual, historical performance is achieved. Such methodology is generally referred to as "history matching" and is used to produce revised estimates of the reservoir storage and flow parameters.

Unlike existing history matching techniques, the present invention provides a novel method for automated history matching which does not depend upon numerous perturbations of a multilayer model or costly numerical reservoir simulator runs. As such, the present invention provides a novel method of history matching a multilayer reservoir, using as starting point, the predicted performance for a single layer model of the multilayer reservoir by the numerical reservoir simulator. Additionally, the present invention provides a novel automated method for obtaining estimates of the flow parameters of the multilayer reservoir as well as predicting future performance of the reservoir under a variety of enhanced hydrocarbon recovery techniques, e.g., changing injection and production well patterns as well as modifying the operating conditions of both production and injection wells.

Figure 3:
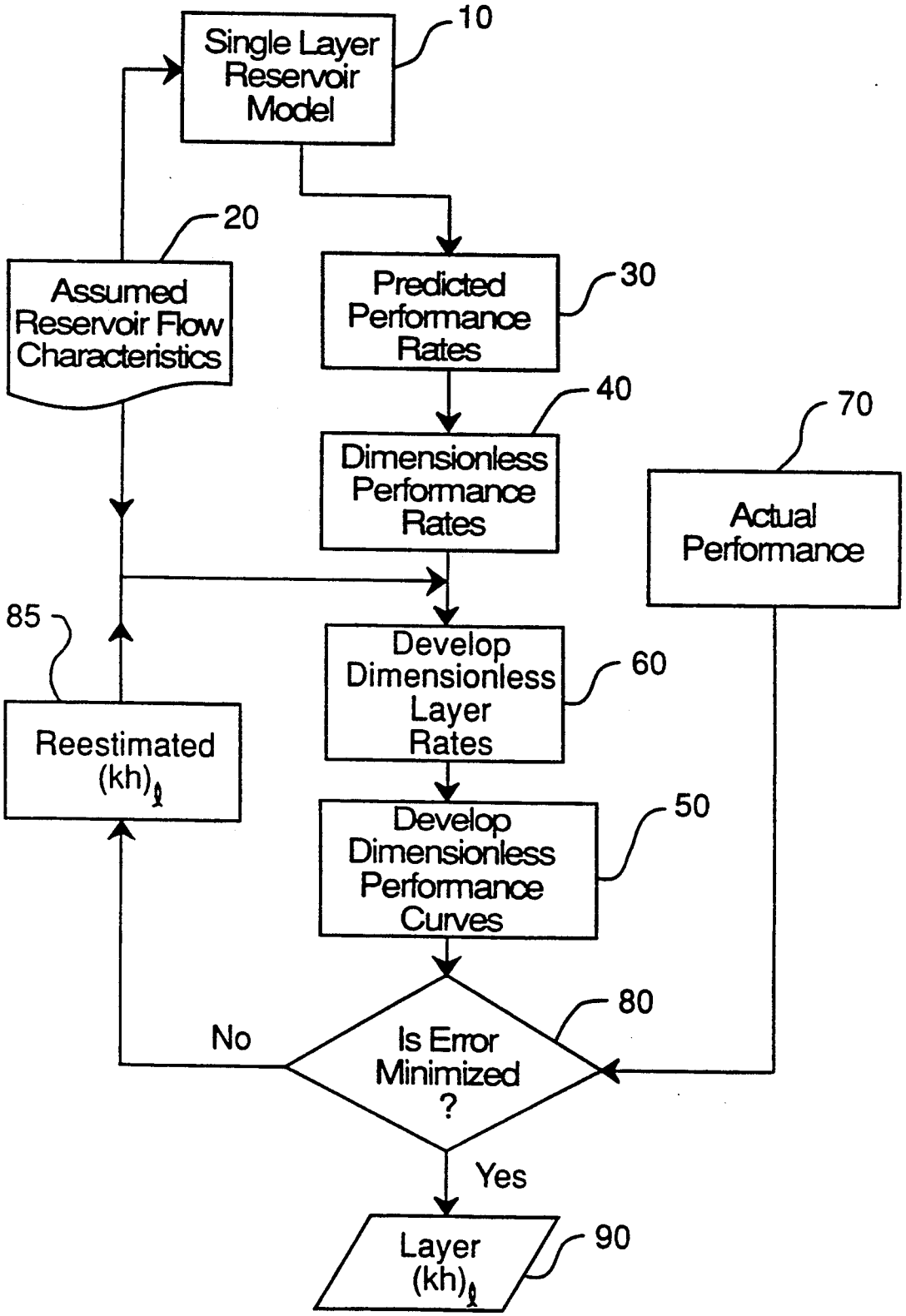
FIG. 3 is a flow diagram of the present invention.

Looking now to FIG. 3, a more detailed description of the present invention is provided. At step 10, a single layer model of a multilayer reservoir of interest is developed. It has been found that a wide range of reservoir storage and flow parameters (e.g., porosity, permeability, layer pressure drop, separation distance between injection and production wells, connate water saturation, etc.) can be assumed at step 20 to construct the single layer model without adversely affecting the results of the present invention. However, it is preferable to use storage and flow parameters which are generally representative of the average storage and flow parameters for the multilayer reservoir of interest. We have found that use of a single layer model, in lieu of more complex multilayer models can afford much improved, as well as more economical, results over existing techniques provided certain assumptions about the multilayer reservoir are not seriously violated:

1) each layer in the multilayer reservoir is generally horizontal and is not in vertical, fluid communication with any other layer; and 2) the reservoir layers are generally of similar formations having similar relative permeability.

To the extent such assumptions are not seriously violated, estimates of the storage and flow parameters for a multilayer reservoir can be obtained using the present invention. However, rigid conformance with such assumptions is not a requisite to obtaining useful results with our technique.

Having thus established a single layer model of the multilayer reservoir of interest, a numerical reservoir simulator can be employed at step 30 to predict performance rates for fluid injection $Q_I$, hydrocarbon production $Q_O$ and fluid production $Q_W$ for the single layer model premised upon an assumed injection and production well pattern as well as on assumed operating conditions for both injection and production wells.

At step 40, a set of dimensionless performance rates can be obtained from the single layer predicted performance rates of step 30. In particular, dimensionless performance rates can be developed for fluid injection rate $Q_{ID}$, hydrocarbon production rate $Q_{OD}$, and fluid production rate $Q_{WD}$.

The dimensionless performance rates are understood to comprise predicted injection and production rates which have been scaled according to predetermined factors so as to be independent of reservoir size or time.

Since initial gas saturation of the multilayer reservoir can strongly affect the dimensionless performance rates, it is generally preferable to generate a series of such dimensionless performance rates for several different initial gas saturations. As noted earlier, variations in other of the reservoir storage and flow parameters have generally been found not to significantly alter the dimensionless performance rates. The dimensionless performance rates for injection and production rates for the single layer model can preferably be constructed by dividing the predicted fluid injection $Q_I$ and the predicted hydrocarbon $Q_o$ and fluid production rates $Q_W$ obtained from the numerical reservoir simulator by the fluid injection rate at floodout q* according to:

$$Q_{OD} = \frac{Q_O}{q^*} \quad (1)$$

$$Q_{WD} = \frac{Q_W}{q^*} \quad (2)$$

$$Q_{ID} = \frac{Q_I}{q^*} \quad (3)$$

Figure 4:
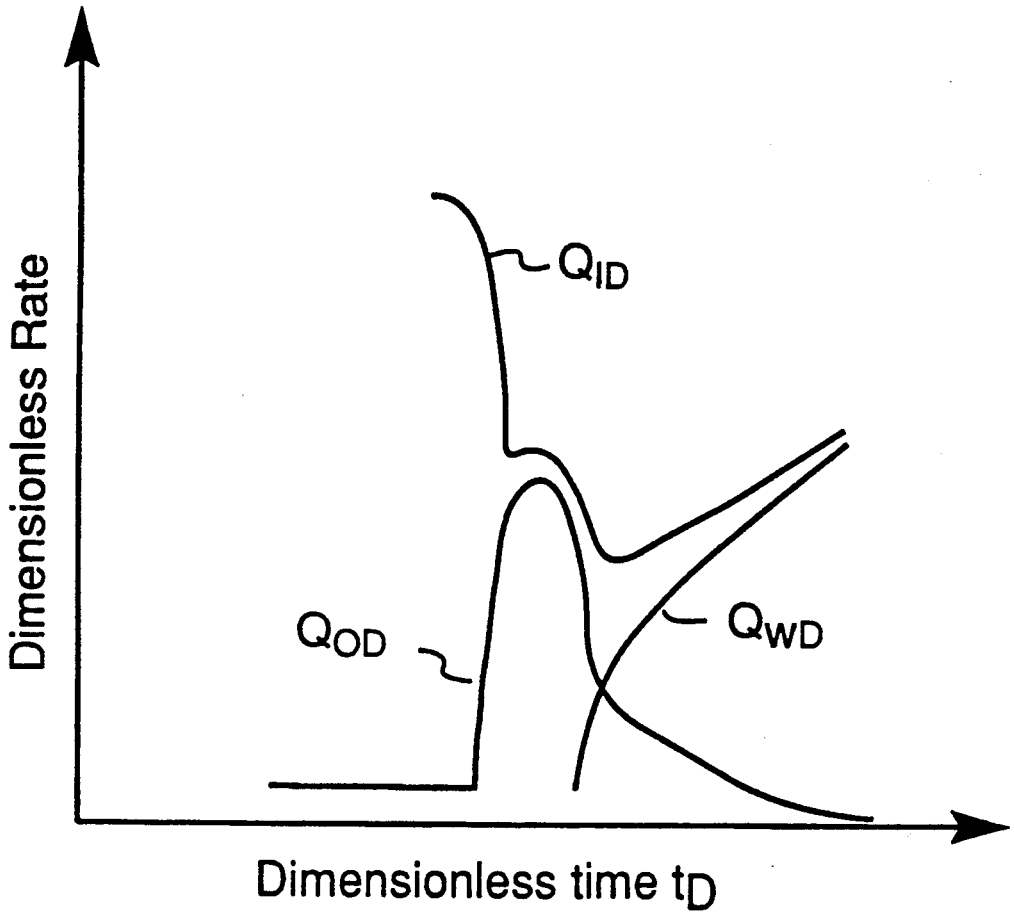
FIG. 4 is a graphical representation of selected dimensionless performance curves.

These dimensionless performance rates can then be plotted as a function of dimensionless time $t_d$ to produce dimensionless performance curves as depicted in FIG. 4. Dimensionless time $t_d$ corresponding to any real time t can be defined as:

$$t_d = \frac{q^*}{V_d} t \tag{4}$$

where $V_d$ is an assumed displaceable hydrocarbon pore volume for the multilayer reservoir. The displaceable hydrocarbon pore volume $V_d$ is proportional to the total porosity-thickness $\phi h$ of the multilayer reservoir. The dimensionless performance curves are primarily dependent on the injection pattern type, layer relative permeabilities, fluid properties and initial gas saturation of the selected multilayer reservoir. The dimensionless performance curves depicted in FIG. 4 were generated from the results of a numerical reservoir simulator prediction for waterflooding a homogeneous single layer model.

Since it has been assumed that there is no crossflow between layers of the multilayer reservoir, each layer is independent of one another. Thus, we have found that the flow rates for each layer can be represented by scaled dimensionless layer flow rates obtained from the single layer model. At step 50, the dimensionless hydrocarbon production rate $Q_{OD}$, fluid production rate $Q_{WD}$ and fluid injection rate $Q_{ID}$ developed from the single layer model can be scaled to provide first estimates of injection and production rates for each selected layer l of the multilayer reservoir according to:

$$Q_{Ol} = C(kh)_l\, Q_{OD} \tag{5}$$
$$Q_{Wl} = C(kh)_l\, Q_{WD} \tag{6}$$
$$Q_{Il} = C(kh)_l\, Q_{ID} \tag{7}$$

Here the permeability-thickness $(kh)_l$ can represent the reservoir flow capacity for the selected layer l of the multilayer reservoir, a first estimate of which can be obtained from the assumed reservoir characteristics at step 20. C is term which includes the effective wellbore radius $r_w$ and is generally related to injection pattern according to:

$$C = \frac{a\,(P_I - P_p)}{b\left[\ln\left(\frac{d}{\sqrt{r_{wp}\, r_{wi}}}\right) + G\right]} \tag{8}$$

where the constants a, b, d, and G are dependent on fluid and rock properties, as well as pattern type and size and distance between injection and production wells.

For unusual injection patterns in which C is unknown, an expression of C for a similar injection pattern can still be used because of the weak sensitivity of C to the effective wellbore radius and because much of the injection pattern factor is implicitly contained in the dimensionless performance rates themselves. Additionally, it is necessary to scale the real time t to a dimensionless time $t_{dl}$ for each layer l of the multilayer reservoir according to:

$$t_{dl} = \frac{C(kh)_l}{V_{dl}} t \tag{9}$$

At step 60, an estimate of the total injection and production rates for the multilayer reservoir can be obtained from the dimensionless injection and production rates for each layer l according to:

$$Q_{OT} = \sum_{l=1}^{N} C(kh)_l Q_{OD} \tag{10}$$

$$Q_{WT} = \sum_{l=1}^{N} C(kh)_l Q_{WD} \tag{11}$$

$$Q_{IT} = \sum_{l=1}^{N} C(kh)_l Q_{ID} \tag{12}$$

where N = number of layers in the multilayer reservoir.

At step 70, actual injection and production rates can be obtained for a plurality of historical times for the multilayer reservoir of interest. At step 80, the actual and estimated injection and production rates for a plurality of times M can be compared and error or difference expressions can be developed according to:

$$e_{injector} = \sum_{i=1}^{M} (Q_{ITi} - A_{Ii})^2 \tag{13}$$

$$e_{producer\text{-}T} = \sum_{i=1}^{M} \{(Q_{OTi} - A_{Oi})w + (Q_{WTi} - A_{Wi})y\}^2 \tag{14}$$

$$e_{producer\text{-}O} = \sum_{i=1}^{M} \{(Q_{OTi} - A_{Oi})^2 \tag{15}$$

$$e_{producer\text{-}W} = \sum_{i=1}^{M} \{(Q_{WTi} - A_{Wi})^2 \tag{16}$$

where $A_{Ii}$, $A_{Oi}$ and $A_{Wi}$ are the actual, historical injection and production rates, respectively, for the fluid and hydrocarbon at M different times. The variables w and y are weighting factors, and the subscript i refers to a rate measurement at a particular time.

The weighting factors (w,y) are arbitrary and are usually set to 1.0. If errors are suspected in some of the rate measurements, the corresponding weighting factors can be adjusted or set to zero. To obtain a history match, the error or difference expressions of Eqs. (13–16) can be minimized by using nonlinear regression methods.

Preferably, the estimated total rates in Eqs. (13–16) can be replaced by the estimated individual layer rates from Eqs. (10–12) and the estimated layer rates can be represented by Taylor series expansions. The Taylor series can be expanded about the variables $\Delta(kh)_l$ and $\Delta r_w$. The Δ's represent a change in these variables from the initial estimates at step 20. By way of example, the error expression for total hydrocarbon and fluid production from Eq. (14) can be represented as:

$$e_{producer\text{-}T} = \sum_{i=1}^{M} \{(Q_{OTi} + Q_{WTi} - A_{Oi} - A_{Wi})^2 \tag{17}$$

where $$Q_{OTi} + Q_{WTi} = \sum_{l=1}^{N} Ckh_l(Q_{ODli} + Q_{WDli})$$

by letting $g_{li} = Ckh_l(Q_{ODli} + Q_{WDli})$ then $$Q_{OTi} + Q_{WTi} = \sum_{l=1}^{N} g_{li} \tag{18}$$

The term $g_{li}$ can be approximated by a truncated Taylor series:

$$g_{li} \simeq g_{lio} + \left(\frac{\partial g_{li}}{\partial kh_l}\right)_o \Delta kh_l + \left(\frac{\partial g_{li}}{\partial r_w}\right)_o \Delta r_w \tag{19}$$

Thus the right portion of Eq. (18) becomes:

$$\sum_{l=1}^{N} g_{li} = \sum_{l=1}^{N} g_{lio} + \sum_{l=1}^{N}\left(\frac{\partial g_{li}}{\partial kh_l}\right)_o \Delta kh_l + \Delta r_w \sum_{l=1}^{N}\left(\frac{\partial g_{li}}{\partial r_w}\right)_o \tag{20}$$

And by substitution into Eq. (17) yields:

$$e_{producer\text{-}T} = \sum_{i=1}^{M}\left\{\left(\sum_{l=1}^{N}\left[\left(\frac{\partial g_{li}}{\partial kh_l}\right)_o \Delta kh_l\right]\right) + \Delta r_w\left[\sum_{l=1}^{N}\left(\frac{\partial g_{li}}{\partial r_w}\right)_o\right] - \left(A_{oi} + A_{Wi} - \left[\sum_{l=1}^{N} g_{lio}\right]\right)\right\}^2 \tag{21}$$

The error expressions of Eqs. (13–16) can be differentiated with respect to $\Delta(kh)_l$ and $\Delta(r_w)$ and set equal to zero. This results in a set of linear equations which can be solved simultaneously in which there is one equation for each unknown. By way of example, to minimize the error expression for total production, Equation (21) can be differentiated with respect to $\Delta kh_l$ for each layer and $\Delta r_w$ and the derivatives set equal to zero. Thus for each layer l, $$\frac{\partial e}{\partial \Delta kh_l} = 0 = 2\sum_{i=1}^{M}\left\{\sum_{l=1}^{N}\left[\left(\frac{\partial g_{li}}{\partial kh_l}\right)_o \Delta kh_l\right] + \Delta r_w\left[\sum_{l=1}^{N}\left(\frac{\partial g_{li}}{\partial r_w}\right)_o\right] - \left(A_{Oi} + A_{Wi} - \left[\sum_{l=1}^{N} g_{lio}\right]\right)\right\}\left(\frac{\partial g_{li}}{\partial kh_l}\right)_o \tag{22}$$

or upon rearranging $$\Delta kh_1 \sum_{i=1}^{M}\left(\frac{\partial g_{li}}{\partial kh_l}\right)_o\left(\frac{\partial g_1}{\partial kh_1}\right)_o + \ldots + \Delta kh_N \sum_{i=1}^{M}\left(\frac{\partial g_{li}}{\partial kh_l}\right)_o\left(\frac{\partial g_{Ni}}{\partial kh_N}\right)_o + \Delta r_{wp}\sum_{i=1}^{M}\left[\sum_{l=1}^{N}\left(\frac{\partial g_{li}}{\partial r_{wp}}\right)_o\right]\left(\frac{\partial g_{li}}{\partial kh_l}\right)_o = \sum_{i=1}^{M}\left[\left(A_{Oi} + A_{Wi} - \left[\sum_{l=1}^{N} g_{lio}\right]\right)\left(\frac{\partial g_{li}}{\partial kh_l}\right)_o\right] \tag{23}$$

The expression of Equation (21) can also be differentiated with respect to $\Delta r_w$ and set equal to zero to yield:

$$\Delta kh_1 \sum_{i=1}^{M}\left\{\left(\frac{\partial g_{li}}{\partial kh_l}\right)_o\left[\sum_{l=1}^{N}\left(\frac{\partial g_{li}}{\partial r_w}\right)_o\right]\right\} + \ldots + \Delta kh_N \sum_{i=1}^{M}\left\{\left(\frac{\partial g_{Ni}}{\partial kh_N}\right)_o\left[\sum_{l=1}^{N}\left(\frac{\partial g_{li}}{\partial r_w}\right)_o\right]\right\} + \Delta r_w \sum_{i=1}^{M}\left(\left[\sum_{l=1}^{N}\left(\frac{\partial g_{li}}{\partial r_w}\right)_o\right]^2\right) = \sum_{i=1}^{M}\left\{\left(A_{Oi} + A_{Wi} - \left[\sum_{l=1}^{N} g_{lio}\right]\right)\left[\sum_{l=1}^{N}\left(\frac{\partial g_{li}}{\partial r_w}\right)_O\right]\right\} \tag{24}$$

Equations (23) and (24) form N+1 equations. Using the initial estimates of $(kh)_{lo}$ (l=1,2, . . . N) and $r_{wo}$, the Δ's can be solved to give new values of $(kh)_l$ and $r_w$. This process can be continued until there is negligible change in the Δ's.

In the process of minimizing the error expressions, the method by which the derivatives of the various rates with respect to $(kh)_l$ are evaluated is described with the following example:

$$\frac{\partial g_{li}}{\partial kh_l} = \left\{Q_{ODl} + Q_{WDli} + t_{dli}\left[\frac{\partial Q_{ODli}}{\partial t_{dli}} + \frac{\partial Q_{WDli}}{\partial t_{dli}}\right]\right\} \tag{25}$$

and $$\frac{\partial Q_{ODl}}{\partial kh_l} = \frac{\partial Q_{ODl}}{\partial t_{dl}} \cdot \frac{\partial t_{dl}}{\partial kh_l} \tag{26}$$

where the expressions $$\frac{\partial Q_{ODli}}{\partial t_{dli}} \text{ and } \frac{\partial Q_{WDli}}{\partial t_{dli}}$$

can be obtained from the modeled one layer dimensionless performance rates $Q_{OD}$ for hydrocarbons and $Q_{WD}$ for fluid production as shown in FIG. 4 and recognizing that:

$$\frac{\partial t_{dl}}{\partial (kh)_l} = \frac{\partial t_{dl}}{\partial q^*_l}\,\frac{\partial q^*_l}{\partial (kh)_l} \tag{27}$$

and that $$q^*_l = C(kh)_l. \tag{28}$$

Eq. (27) can thus be further evaluated according to:

$$\frac{\partial t_{dli}}{\partial q^*_l} = \frac{t}{V_{dl}} \tag{29}$$

and $$\frac{\partial q^*_l}{\partial (kh)_l} = C \tag{30}$$

where Eqs. (29 and 30) can be substituted into Eq. (27) which is then substituted into Eq. (26).

The set of linear equations can be solved iteratively to minimize the Δ's to less than a prescribed level. The change in reservoir parameters will generally decrease with each iteration. Computation time to solve these equations is extremely small. If a minimum is obtained, a measure of each layer's flow capacity $(kh)_l$ can be obtained at step 90. However, if the most recent estimate of the flow capacity $(kh)_l$ does not result in minimizing the error expressions of Eq. (13–16), a revised estimate of the flow capacity $(kh)_l$ for each layer can be developed at step 85 from the calculation of $\Delta(kh)_l$ obtained at step 80 and then repeating steps 50–80 with the revised estimate of $(kh)_l$.

Each well's set of equations can be solved separately. Since the flow capacity $(kh)_l$ will, in general, be somewhat different for each well, due to areal reservoir heterogeneities, the interwell $(kh)_l$'s can be obtained by contouring the computed $(kh)_l$'s. By using areally homogeneous dimensionless performance curves, the subject algorithm assumes areal variations in kh are significantly less than vertical variations. In addition to providing a novel method for obtaining values of the flow capacity for each layer of a multilayer reservoir, the present invention also provides a greatly simplified approach to thereafter predict future performance of the multilayer reservoir under varying injection and production well patterns as well as varying injection and production well operating conditions. Thus, the reservoir engineer can more readily evaluate various injection and production well patterns as well as operating conditions thereof so as to optimize hydrocarbon production from the multilayer reservoir.

The present method was developed to history match on $(kh)_l$ for each layer and $r_w$ for producing wells. It is assumed that the porosity-thickness $(\phi h)_l$ is generally known for each layer. Geological and well log data are generally available to provide values for the porosity-thickness products. If this latter set of variables were also solved for, there would be considerable nonuniqueness in the computed reservoir description. Also, the porosity-thickness values are known with more certainty than the layer permeability thickness $(kh)_l$ values and to treat them with as much uncertainty can be misleading.

Looking now to FIGS. 5 to 13, examples of the present invention are depicted wherein the injected fluid is water and the produced hydrocarbon is oil. The following examples were based upon a model of a four layer reservoir similar to that depicted in FIGS. 2a and 2b in which:

1.) a five-spot injection pattern is used;
2.) the $(\phi h)_l$ for each layer is known and
3.) injection and production pressures are known;
4.) only $(kh)_l$ is unknown; however, there exists one set of values of $(kh)_l$ that will produce an exact history match.

There are several methods of history matching according to the present invention which can advantageously be employed to determine reservoir flow characteristics $(kh)_l$ and they include either individually or in combination: matching hydrocarbon production rates, matching fluid production rates, matching the sum of hydrocarbon and fluid production rates, and matching fluid injection rates.

Figure 5:
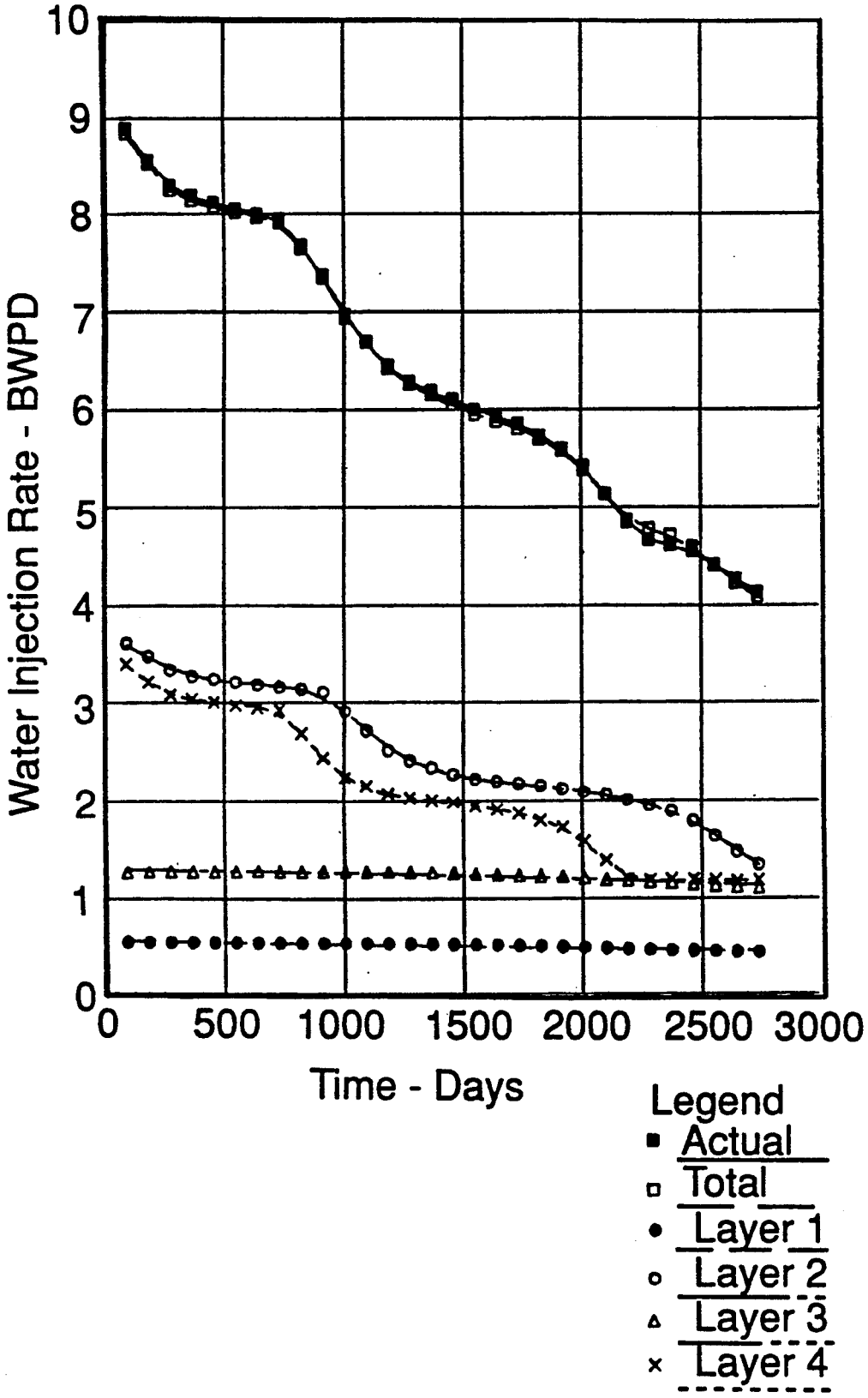
FIG. 5 depicts a comparison of the actual water injection rate to predicted total water injection rate, from all layers, as well as the predicted rates for each layer using values of permeability thickness $(kh)_l$ derived from automatic history matching water injection rates.

Specifically, FIG. 5 depicts the results of employing the history matching technique of the present invention to determine a value for $(kh)_l$ for each layer of the four layer reservoir by automatically matching actual fluid injection rates with the fluid injection rates predicted from the dimensionless performance curves. The automated history matching was initiated by guessing values of $(kh)_l$ for each layer, and thereafter matching injection performance rates. In particular, FIG. 5 depicts the comparison of the total actual fluid injection rate with the predicted fluid injection rate from all layers as well as displays the predicted injection rates for each layer. The match between actual and predicted total fluid injection rates is quite good. A comparison of the actual and final estimated values $(kh)_l$ for each layer as well as the initial estimate $(kh)_l$, input from step 20 of FIG. 3, are set forth in Table II.

TABLE II

| | Initial Estimate | Final Estimate | Actual |
|---|---|---|---|
| layer 1 | 3.590 | 4.259 | 3.580 |
| layer 2 | 32.000 | 22.518 | 11.750 |
| layer 3 | 17.300 | 10.135 | 26.060 |
| layer 4 | 58.500 | 20.741 | 16.550 |
| Total | 111.390 | 57.654 | 57.940 |

Figure 6:
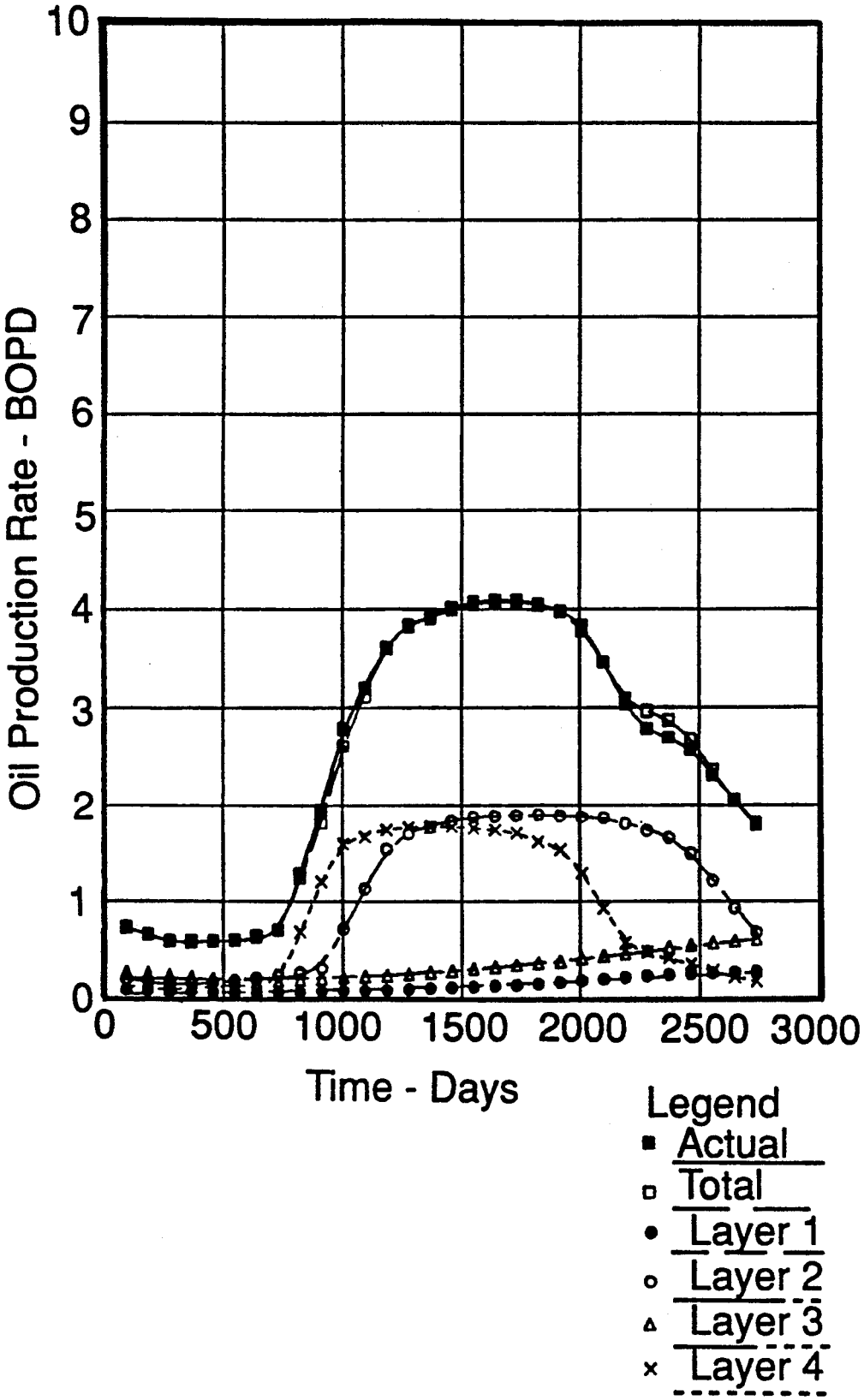
FIG. 6 depicts a comparison of the actual oil production rate to predicted total oil production rate, from all layers, as well as the predicted rates for each layer using values of permeability thickness $(kh)_l$ derived from automatic history matching water injection rates.

In FIG. 6, predicted oil production rates generally compare favorably to actual oil production rates wherein the predicted oil production rates were obtained using values of $(kh)_l$ obtained from history matching fluid injection rates in Table II.

Figure 7:
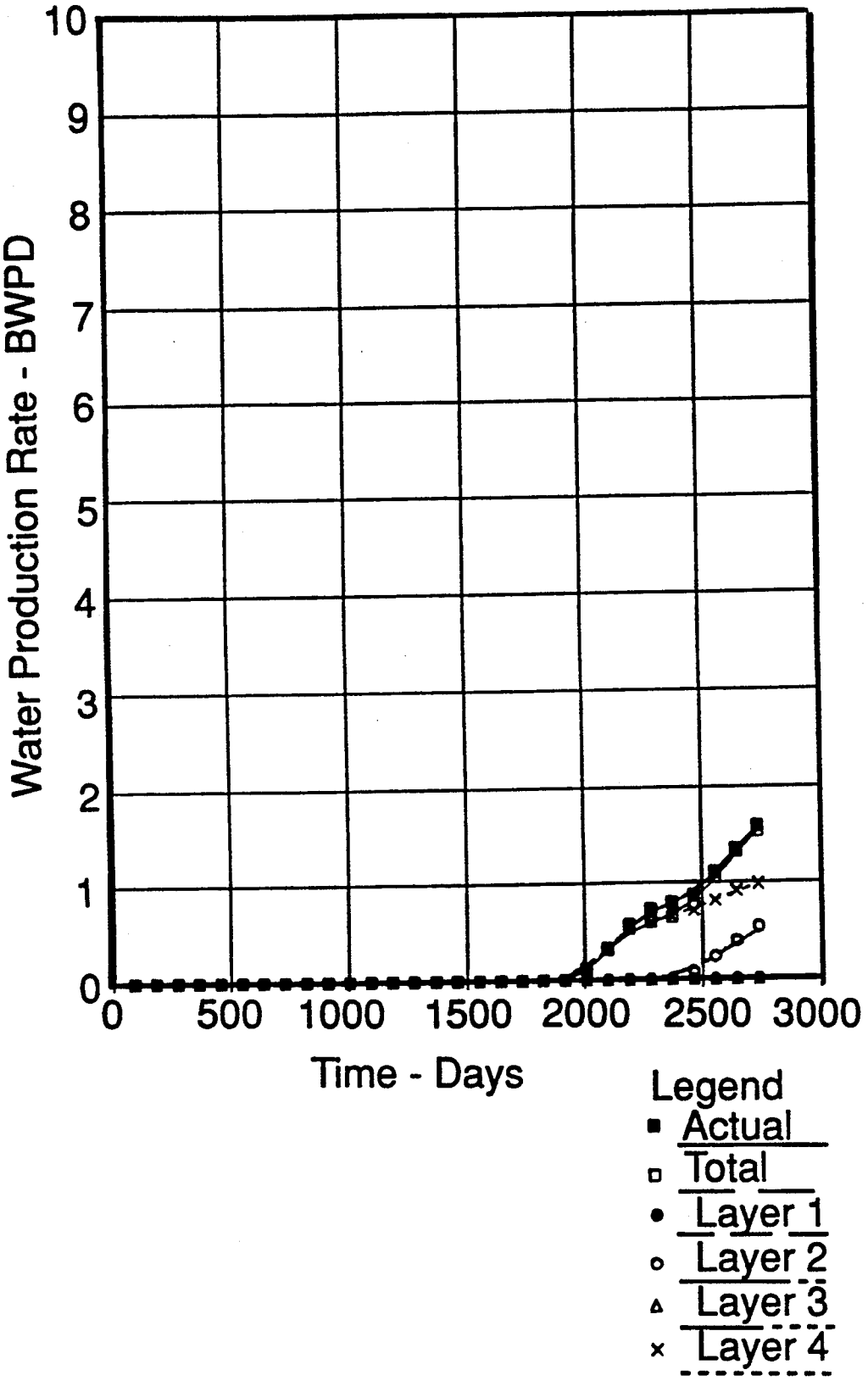
FIG. 7 depicts a comparison of the actual water production rate to predicted total water production rate, from all layers, as well as the predicted rates for each layer using values of permeability thickness $(kh)_l$ derived from automatic history matching water injection rates.

Similarly, FIG. 7 depicts actual and predicted water production rates, wherein the predicted water production rates were obtained using values of $(kh)_l$ obtained from history matching fluid injection rates in Table II.

The utility of FIGS. 6 and 7 is to aid the reservoir engineer in verifying that values of $(kh)_l$ determined for matching one set of flow rates will yield a satisfactory match of the other flow rates. More particularly, if such displays allow the reservoir engineer to determine whether or not the values of $(kh)_l$ simply represent local minimum or a true minimum in the minimization of error expression.

Figure 8:
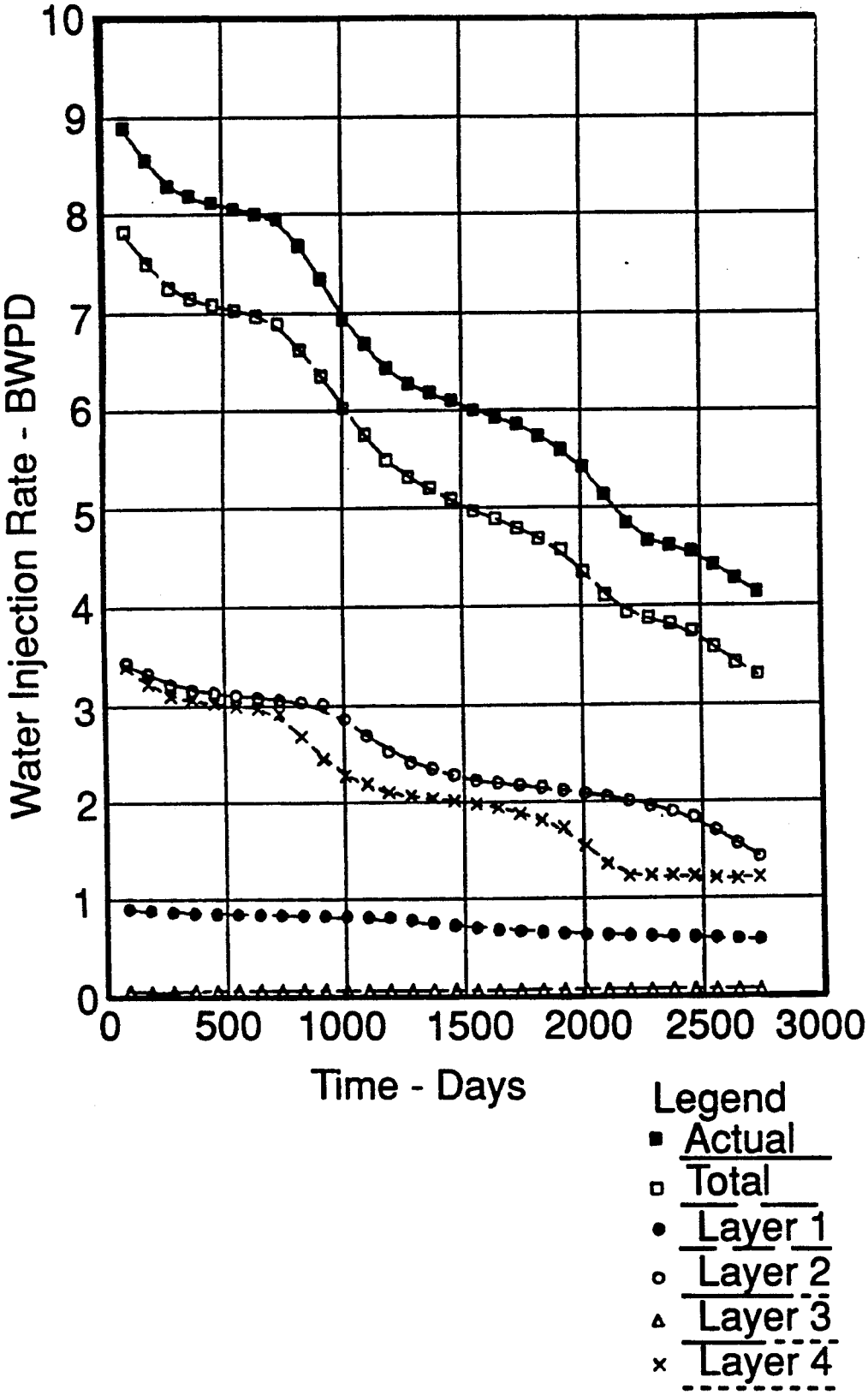
FIG. 8 depicts a comparison of the actual water injection rate to predicted total water injection rate, from all layers, as well as the predicted rates for each layer using values of permeability thickness $(kh)_l$ derived from automatic history matching the sum of oil and water production rates.
Figure 9:
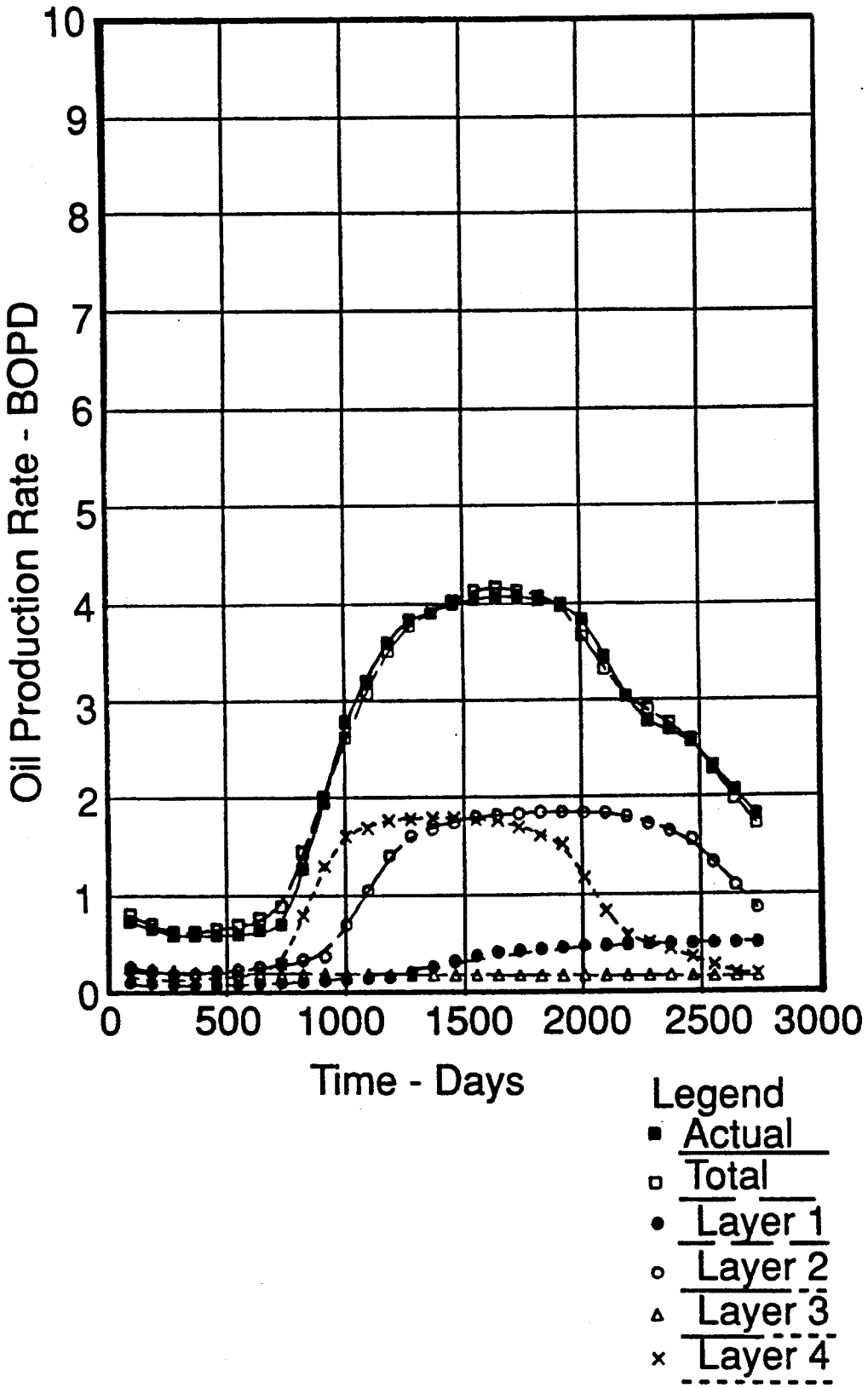
FIG. 9 depicts a comparison of actual oil production rate to predicted total oil production rate, from all layers, as well as the predicted rates for each layer using values of permeability thickness $(kh)_l$ derived from automatic history matching the sum of oil and water production rates.
Figure 10:
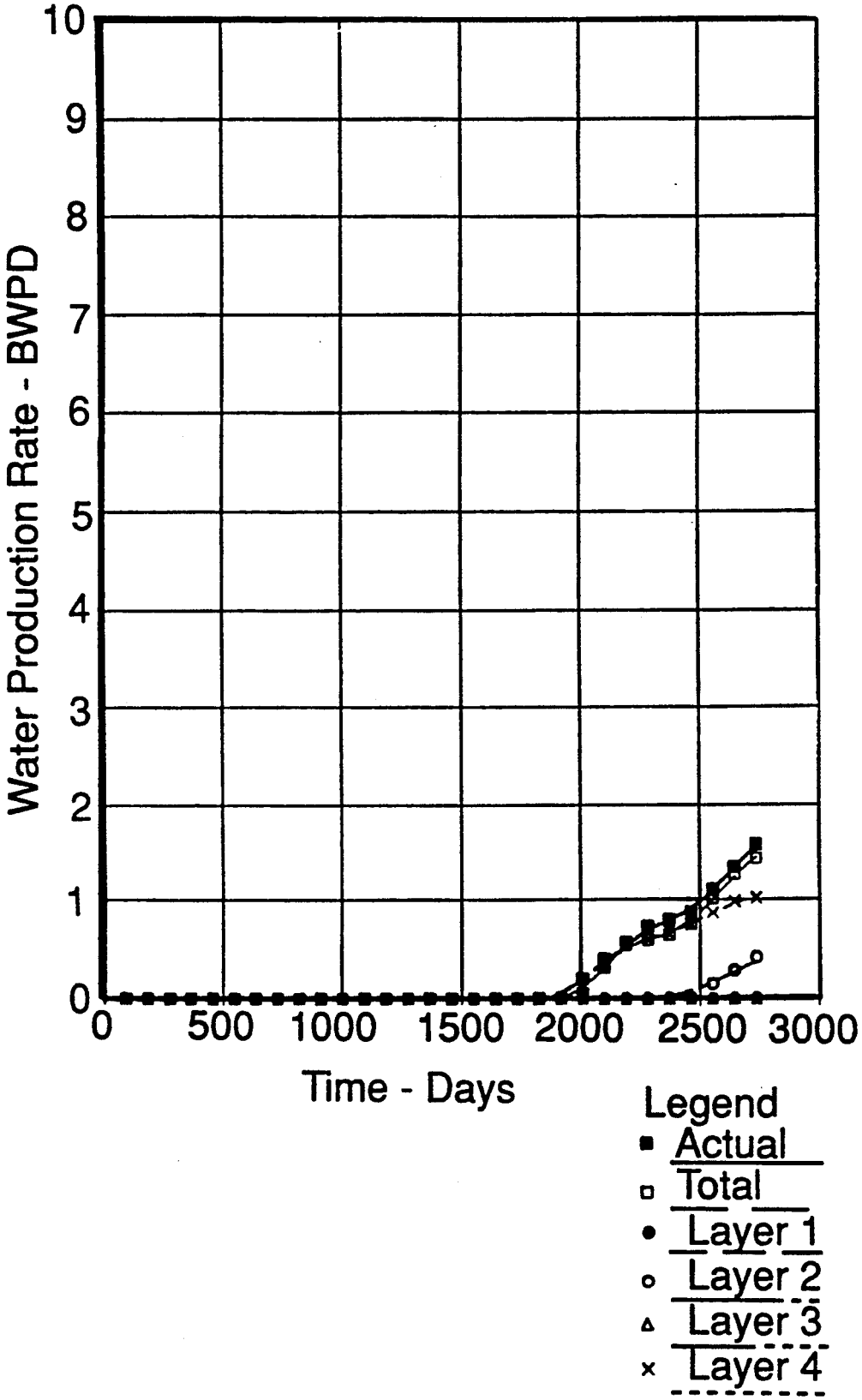
FIG. 10 depicts a comparison of the actual water production rate to total predicted water production rate, from all layers, as well as the predicted rates for each layer using values of permeability thickness $(kh)_l$ derived from automatic history matching the sum of oil and water production rates.

Looking now to FIGS. 8–10, three different sets of automatic history matching rates are depicted. In particular, automated history matching of the sum of hydrocarbon and fluid production rates was employed to obtain values of $(kh)_l$ for each layer. In particular, Table III below depicts the initial estimates, the final estimate and the actual values of $(kh)_l$ for each layer. In FIG. 8, the values of $(kh)_l$ from Table III were employed to calculate water injection rates. In FIGS. 9 and 10, the values of $(kh)_l$ from Table III were used to both calculate oil and water production rates, respectively. The match of predicted oil production rates to the actual oil production rates is quite good even if the match of water injection rates in FIG. 8 is poor. Such anomalous results give rise to the need for history matching on different rates.

TABLE III

| | Initial Estimate | Final Estimate | Actual |
|---|---|---|---|
| layer 1 | 3.590 | 6.246 | 3.580 |
| layer 2 | 32.000 | 22.203 | 11.750 |
| layer 3 | 17.300 | 1.173 | 26.060 |
| layer 4 | 58.500 | 21.129 | 16.550 |
| Total | 111.390 | 50.751 | 57.940 |

Figure 11:
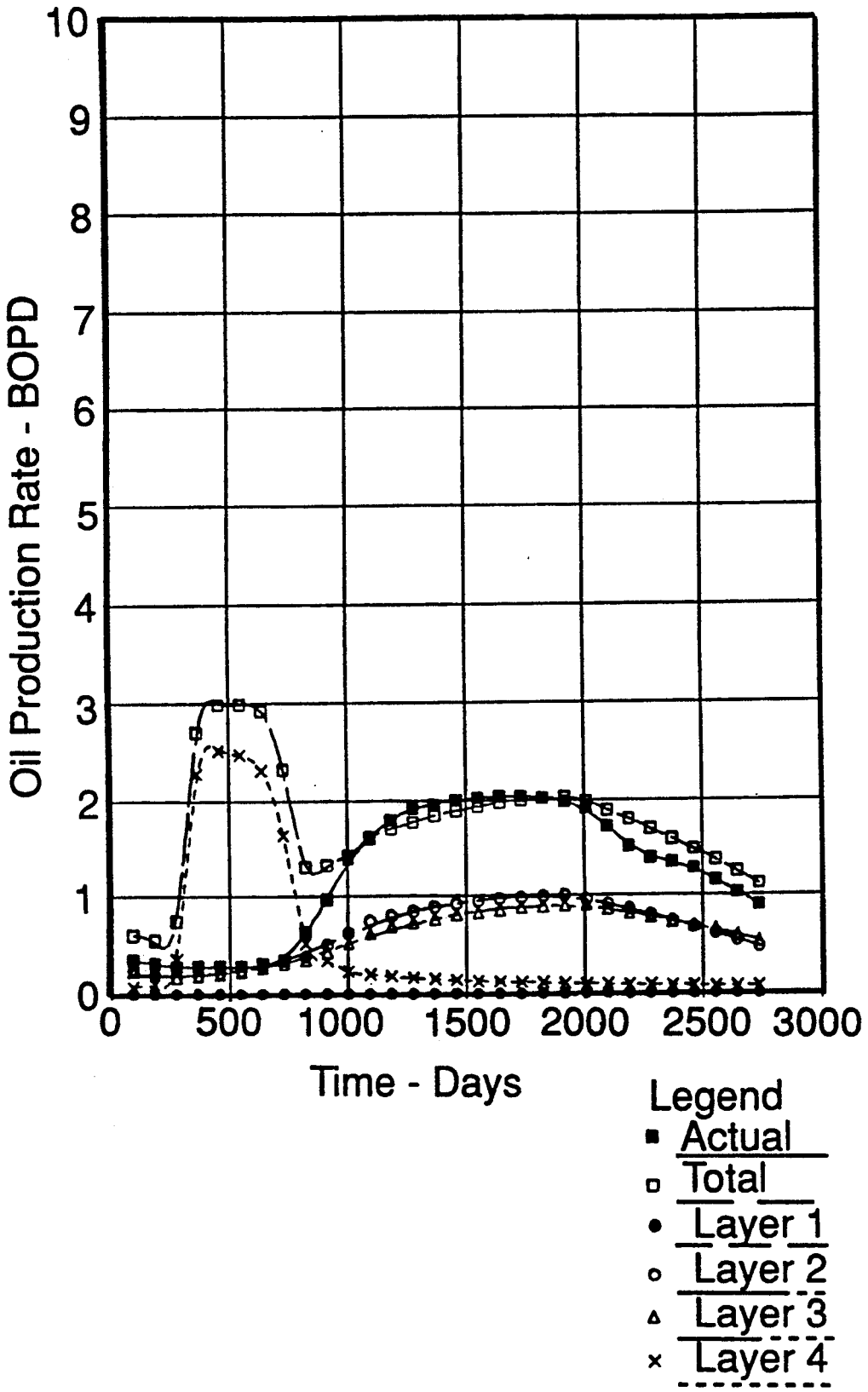
FIG. 11 depicts a comparison of the actual oil production rate to total predicted oil production rate, from all layers, as well as the predicted rates for each layer using the values of permeability thickness $(kh)_l$ derived from automatic history matching oil production rates.

FIG. 11 represents an automated history match of actual and predicted oil production rates to obtain values of $(kh)_l$ for each layer which are depicted in Table IV. While the fit is obviously poor, this probably results from the minimization process having determined a local minimum.

TABLE IV

| | Initial Estimate | Final Estimate | Actual |
|---|---|---|---|
| layer 1 | 3.590 | .100 | 3.580 |
| layer 2 | 32.000 | 24.792 | 11.750 |
| layer 3 | 17.300 | 22.575 | 26.060 |
| layer 4 | 58.500 | 57.619 | 16.550 |
| Total | 111.390 | 105.087 | 57.940 |

Figure 12:
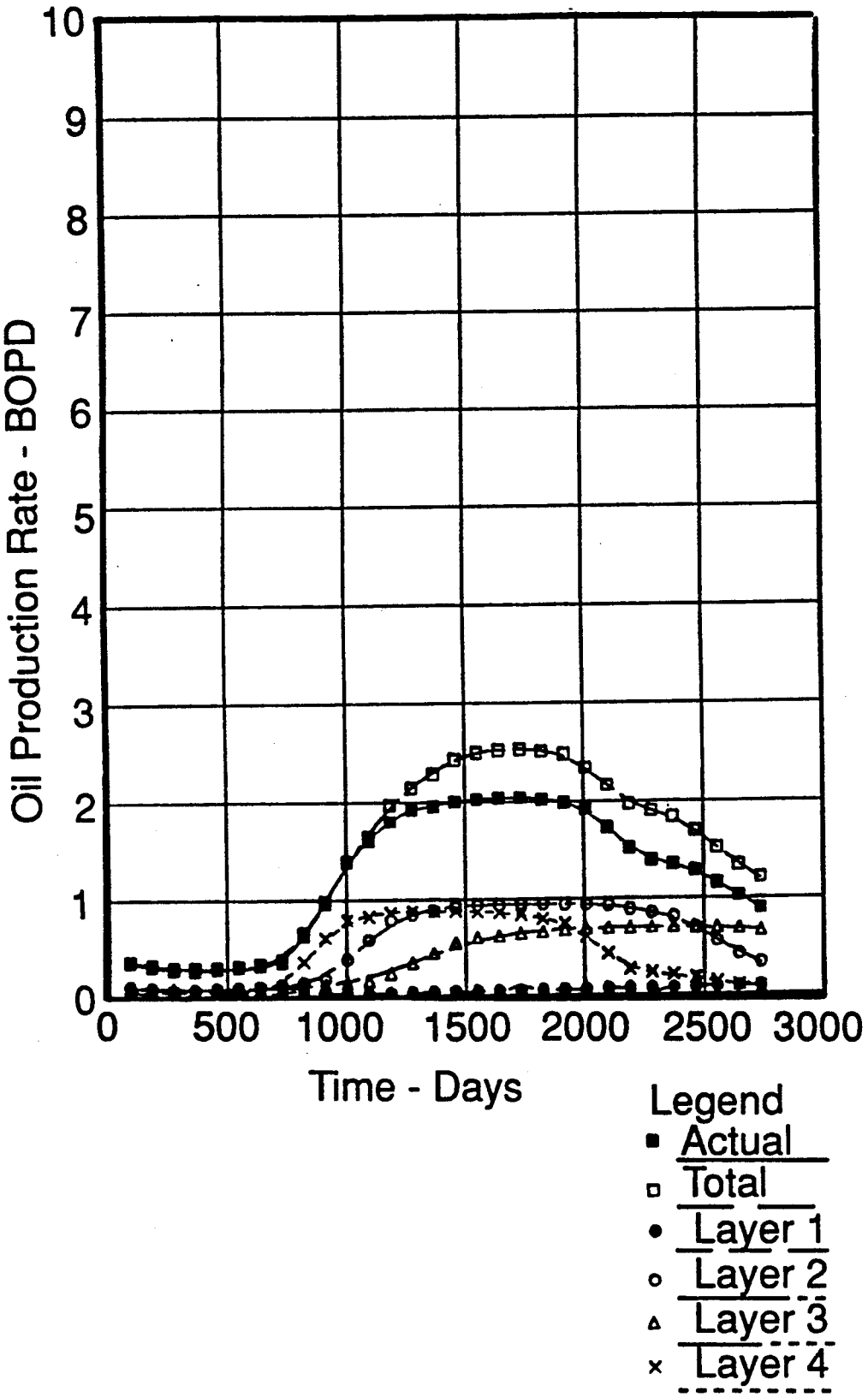
FIG. 12 depicts a comparison of the actual oil production rate to total predicted oil production rate, from all layers, as well as the predicted rates for each layer using the values of permeability thickness $(kh)_l$ derived from automatic history matching water production rates.
Figure 13:
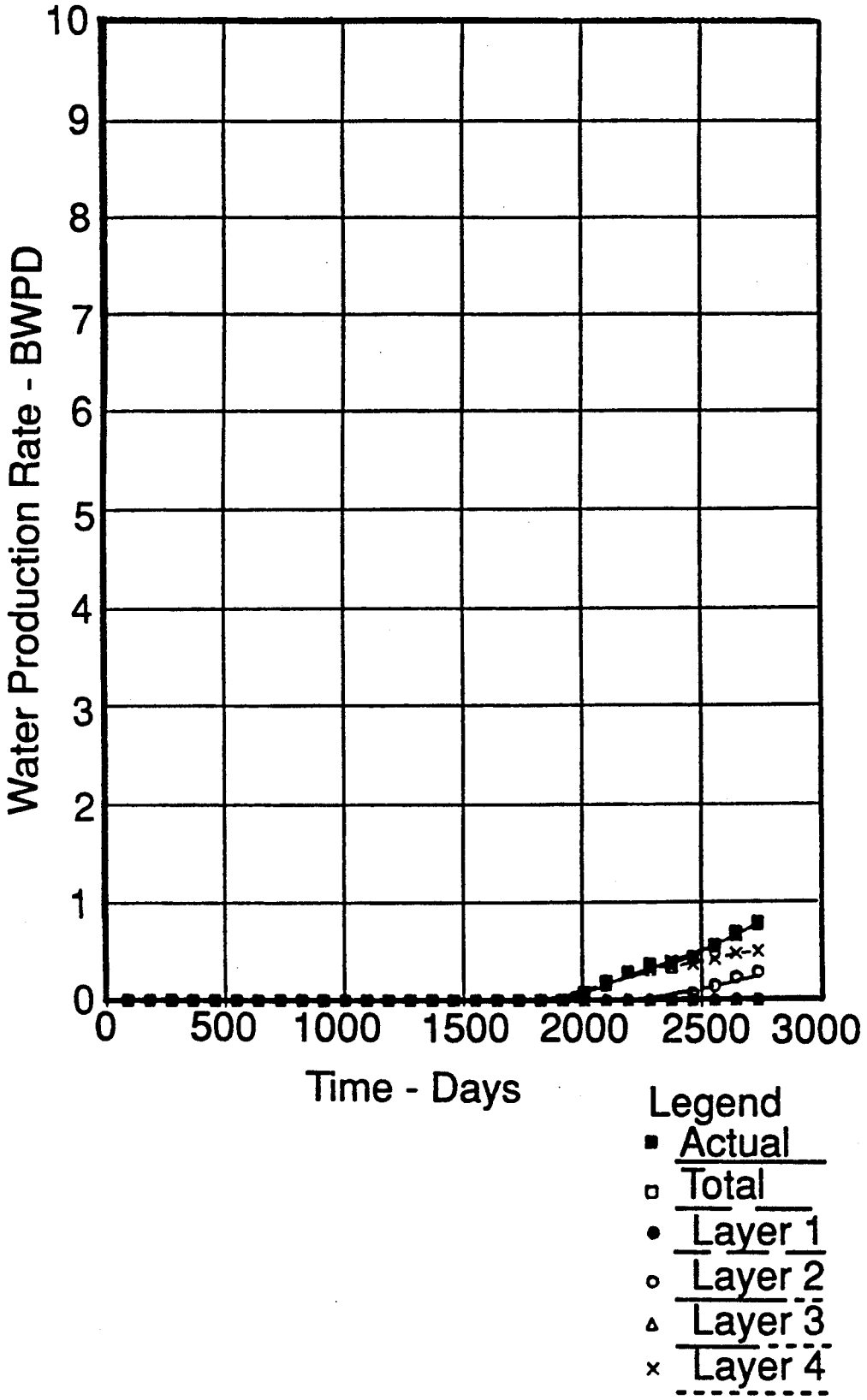
FIG. 13 depicts a comparison of the actual water production rate to total predicted water production rate, from all layers, as well as the predicted rates for each layer using values of permeability thickness $(kh)_l$ derived from automatic history matching water production rates.

FIGS. 12–13 depict the results of first calculating the values of $(kh)_l$ by history matching actual and predicted water production rates to determine values of $(kh)_l$ shown in Table V. In fact, FIG. 13 depicts the match of actual and predicted water production rates while FIG. 12 depicts the match of actual and predicted oil production rates.

TABLE V

| | Initial Estimate | Final Estimate | Actual |
|---|---|---|---|
| layer 1 | 3.590 | 3.590 | 3.580 |
| layer 2 | 32.000 | 22.759 | 11.750 |
| layer 3 | 17.300 | 17.300 | 26.060 |
| layer 4 | 58.500 | 20.883 | 16.550 |
| Total | 111.390 | 64.532 | 57.940 |

While the present invention has been described in conjunction with an example of water injection to recover oil, those skilled in the art will appreciate that changes to certain of the steps could be made and that the present is properly understood to include the use of a wide range of injected fluids to produce a variety of different types of hydrocarbons. As such, the present invention is to be limited only by claims attached herewith.

We claim:

1. A method of enhanced hydrocarbon recovery from multilayer subterranean reservoirs, the reservoir being penetrated by at least one injection well and at least one production well, the at least one injection well and at least one production well having a spacing therein-between and a pattern of injection well and production well placement, the method comprising the steps of:

a) forming a single layer reservoir model having a set of assumed flow parameters representative of a multilayer reservoir of interest and having at least one injection well and at least one production well, the at least one injection well and the at least one production well having a first set of injection and production well operating conditions;

b) developing at least one predicted injection well flow rate and at least one predicted production well flow rate for the single layer reservoir model;

c) scaling the predicted flow rates developed in step b) to obtain dimensionless flow rates for the single layer reservoir model;

d) obtaining a set of estimated flow rates for each layer of the multilayer reservoir from the dimensionless flow rates of step c);

e) minimizing differences between the set of estimated flow rates obtained in step d) and actual multilayer reservoir flow rates to obtain a measure of the flow parameters of each layer of the multilayer reservoir, the measure including layer permeability; and f) utilizing the measure of the flow parameters for each layer of the multilayer reservoir to optimize at least one of the spacing and the pattern of the at least one injection well and the at least one production well and improve the recovery of hydrocarbons from the multilayer reservoir.

2. The method of claim 1, wherein:

the at least one predicted production well flow rate of step b) is selected from the group including: fluid production and hydrocarbon production.

3. The method of claim 2, wherein the fluid production rates are selected from the group including: water, $CO_2$, $N_2$, gas and steam.

4. The method of claim 2, wherein the hydrocarbon production rates are selected from the group including: oil and gas.

5. The method of claim 1, wherein the step of minimizing differences includes minimizing the differences in flow rates selected from the group including: estimated and actual fluid injection rates; estimated and actual fluid production rates; and estimated and actual hydrocarbon production rates.

6. The method of claim 1, wherein step e) comprises the steps of:

ea) forming an error expression between estimated flow rates and actual flow rates according to at least one of the following:

$$e_{injector} = \sum_{i=1}^{M} (Q_{ITi} - A_{Ii})^2$$

$$e_{producer\text{-}T} = \sum_{i=1}^{M} \{(Q_{OTi} - A_{Oi})w + (Q_{WTi} - A_{Wi})y\}^2$$

$$e_{producer\text{-}O} = \sum_{i=1}^{M} \{(Q_{OTi} - A_{Oi})^2$$

$$e_{producer\text{-}W} = \sum_{i=1}^{M} \{(Q_{WTi} - A_{Wi})^2$$

where:

$Q_{ITi}$=estimate of total fluid injection at time i $A_{Ii}$=actual fluid injection at time i $Q_{OTi}$=estimate of total hydrocarbon production at time i $A_{Oi}$=actual hydrocarbon production at time i $Q_{WTi}$=estimate of total fluid production at time i $A_{Wi}$=actual fluid production at time i M=plurality of time intervals; and w and y are constants; and eb) minimizing the error expression formed in step ea) by utilizing nonlinear regression methods to obtain a measure of the flow parameters of each layer of the multilayer reservoir.

7. The method of claim 1, wherein the at least one predicted injection well flow rate of step b) comprises water injection rate.

8. The method of claim 1, wherein the at least one predicted injection well is injected with at least one of water, carbon dioxide, nitrogen, gas and steam.

9. The method of claim 1, wherein the at least one predicted injection well flow rate of step b) is selected from the group including: carbon dioxide injection rate, water injection rate, nitrogen injection rate, gas injection rate, and steam injection rate.

10. A method of enhanced hydrocarbon recovery from multilayer subterranean reservoirs, each layer of the reservoir being penetrated by at least one water injection well and at least one hydrocarbon production well and being characterized by a spacing between wells and a well placement pattern and a set of actual flow rates, the method comprising the steps of:

a) for each layer of the subterranean reservoir of interest, forming a single layer reservoir model having a set of assumed flow parameters and operating conditions;

b) developing a predicted water injection well flow rate and a predicted production well flow rate for the single layer reservoir model;

c) scaling the predicted flow rates developed in step b) to obtain dimensionless flow rates for the single layer reservoir model;

d) obtaining a set of estimated flow rates for each layer of the multilayer reservoir from the dimensionless flow rates of step c);

e) minimizing the differences between the set of estimated flow rates obtained in step d) and actual multilayer reservoir flow rates to obtain a measure, including layer permeability, of the flow parameters of each layer of the multilayer reservoir; and f) utilizing the measure of the flow parameters for each layer of the multilayer reservoir to optimize the operating conditions of the injection well and the production well and to improve the production of hydrocarbons from the multilayer reservoir.

* * * * *